US010895388B2

(12) United States Patent
Shirota et al.

(10) Patent No.: US 10,895,388 B2
(45) Date of Patent: Jan. 19, 2021

(54) INDOOR UNIT AIR-CONDITIONING APPARATUS

(71) Applicant: Mitsubishi Electric Corporation, Tokyo (JP)

(72) Inventors: Mitsuhiro Shirota, Tokyo (JP); Takashi Ikeda, Tokyo (JP); Takahiro Shishido, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 26 days.

(21) Appl. No.: 15/780,300

(22) PCT Filed: Feb. 3, 2016

(86) PCT No.: PCT/JP2016/053160
§ 371 (c)(1),
(2) Date: May 31, 2018

(87) PCT Pub. No.: WO2017/134762
PCT Pub. Date: Aug. 10, 2017

(65) Prior Publication Data

US 2018/0363927 A1 Dec. 20, 2018

(51) Int. Cl.
*F24F 1/0014* (2019.01)
*F24F 13/20* (2006.01)
(Continued)

(52) U.S. Cl.
CPC ..... *F24F 1/0014* (2013.01); *F24F 1/0011* (2013.01); *F24F 1/0057* (2019.02);
(Continued)

(58) Field of Classification Search
CPC ..... F24F 13/15; F24F 1/0057; F24F 1/0011; F24F 13/20; F24F 2221/28; F24F 13/14; F24F 2013/205
See application file for complete search history.

(56) References Cited

U.S. PATENT DOCUMENTS 5,234,373 A * 8/1993 Yamazaki ..... F24F 1/0011 454/319
5,547,018 A * 8/1996 Takahashi ..... F24F 1/0011 165/267
(Continued)

FOREIGN PATENT DOCUMENTS

CN 103597293 A 2/2014
CN 204629746 U 9/2015
(Continued)

OTHER PUBLICATIONS

Extended European Search Report dated Jan. 16, 2019 issued in corresponding EP patent application No. 16889252.9.
(Continued)

*Primary Examiner* — Kun Kai Ma
(74) *Attorney, Agent, or Firm* — Posz Law Group, PLC

(57) ABSTRACT

An indoor unit for an air-conditioning apparatus, which prevents adhesion of dew condensation water to up-and-down airflow direction louvers while directing blowing air to an intended direction, includes: a casing; an air inlet; an air outlet; an indoor heat exchanger and an indoor fan; an up-and-down airflow direction louver; and an up-and-down airflow direction auxiliary louver. The up-and-down airflow direction louver includes: an upstream guide surface and a downstream guide surface. The up-and-down airflow direction auxiliary louver includes an upstream end portion, the upstream end portion being positioned on an inner side of the air outlet passage relative to the downstream guide surface and being positioned on the upstream side relative to a downstream guide surface distal end portion of the downstream guide surface, which is an end portion of the downstream guide surface on the downstream side of the air outlet passage.

12 Claims, 7 Drawing Sheets

(51) Int. Cl.
*F24F 1/0011* (2019.01)
*F24F 13/14* (2006.01)
*F24F 1/0057* (2019.01)

(52) U.S. Cl.
CPC ..... *F24F 13/14* (2013.01); *F24F 13/20* (2013.01); *F24F 2013/205* (2013.01); *F24F 2221/28* (2013.01)

(56) References Cited

U.S. PATENT DOCUMENTS 5,888,133 A * 3/1999 Mori ..... F24F 1/0011 454/318
5,924,923 A * 7/1999 Chiguchi ..... F24F 1/0011 454/256
6,086,324 A * 7/2000 Ikeda ..... F04D 17/04 415/53.1
6,338,382 B1 * 1/2002 Takahashi ..... F24F 1/0007 165/96
6,338,676 B1 * 1/2002 Kondou ..... F24F 1/0007 454/315
2002/0144513 A1 * 10/2002 Gunji ..... F24F 1/0007 62/263
2003/0167786 A1 * 9/2003 Nakagawa ..... F24F 1/0007 62/285
2004/0007002 A1 * 1/2004 Asami ..... F24F 1/0011 62/186
2004/0060314 A1 * 4/2004 Gunji ..... F24F 1/0007 62/262
2007/0060036 A1 * 3/2007 Shibuya ..... B01D 46/0065 454/187
2015/0040602 A1 * 2/2015 Park ..... F24F 1/0007 62/291
2015/0056910 A1 * 2/2015 Ikeda ..... F24F 1/0018 454/252
2015/0176850 A1 * 6/2015 Nakai ..... F24F 13/1426 454/329
2015/0292508 A1 * 10/2015 Ikeda ..... F04D 29/283 415/208.2
2015/0377503 A1 * 12/2015 Nakamoto ..... F24F 13/10 62/176.1
2016/0025357 A1 1/2016 Suzuki et al.

FOREIGN PATENT DOCUMENTS

EP 1245907 A3 * 4/2004 ..... F24F 1/0057
EP 2977689 A2 1/2016
EP 3124887 A1 2/2017
JP 2014-178072 A 9/2014
KR 1020140101286 * 8/2014
WO WO-2010026718 A1 * 3/2010 ..... F24F 1/0057
WO 2013/035236 A1 3/2013
WO 2013/088679 A1 6/2013
WO 2015/145726 A1 10/2015
WO WO-2017043479 A1 * 3/2017 ..... F24F 13/14

OTHER PUBLICATIONS

Office action dated Jun. 5, 2019 issued in corresponding CN patent application No. 201680003271.X (and English translation thereof).
International Search Report of the International Searching Authority dated May 10, 2016 for the corresponding international application No. PCT/JP2016/053160 (and English translation).

* cited by examiner

INDOOR UNIT AIR-CONDITIONING APPARATUS

CROSS REFERENCE TO RELATED APPLICATION

This application is a U.S. national stage application of International Application No. PCT/JP2016/053160, filed on Feb. 3, 2016, the contents of which are incorporated herein by reference.

TECHNICAL FIELD

The present invention relates to an indoor unit for an air-conditioning apparatus, and more particularly, to an airflow direction louver configured to adjust a direction of blowing air in an up-and-down direction.

BACKGROUND

A related-art indoor unit for an air-conditioning apparatus includes a fan arranged in an air passage continuous from an air inlet to an air outlet, and a heat exchanger arranged in a periphery of the fan. The indoor unit further includes an airflow direction louver configured to adjust a direction of blowing air in an up-and-down direction. For the airflow direction louver, a measure is taken to prevent dew condensation during a cooling operation while freely controlling a direction of an airflow blown out through the air outlet from a front direction to a downward direction of the indoor unit.

For example, an indoor unit for an air-conditioning apparatus disclosed in Patent Literature 1 includes an air outlet in a lower portion of a casing. In the air outlet, there are provided two airflow direction louvers configured to adjust a direction of blowing air in an up-and-down direction, and the two up-and-down airflow direction louvers cover the air outlet during stop of an operation. During the operation, the up-and-down airflow direction louvers are opened in a downward direction to open the air outlet, thereby sending air in a front direction or the downward direction.

PATENT LITERATURE

Patent Literature 1: Japanese Unexamined Patent Application Publication No. 2014-178072

However, according to the technology disclosed in Patent Literature 1, during a cooling operation of the indoor unit for an air-conditioning apparatus, in order to cause the blowing air blown out from the fan to flow in, for example, a horizontal direction, it is necessary to direct the two airflow direction louvers, which are configured to adjust the direction of the blowing air in the up-and-down direction, horizontally. At this time, the two airflow direction louvers rotate about respective rotation shafts at an outlet part of the air outlet. Further, in order to cause the blowing air to flow along both front and back surfaces of each of the up-and-down airflow direction louvers so as to prevent occurrence of dew condensation on each of the up-and-down airflow direction louvers, it is necessary to arrange the two airflow direction louvers in a range of an opening of the air outlet. Therefore, when the two airflow direction louvers are directed horizontally on an inner side of the opening portion of the air outlet, the air outlet is narrowed. As a result, there is a problem in that the air passage resistance is increased, and the air volume of the blowing air is reduced, thereby degrading the air-conditioning performance of the air-conditioning apparatus.

SUMMARY

The present invention has been made to solve the problem described above, and has an object to provide an indoor unit for an air-conditioning apparatus, which secures an area of an opening of an air outlet while directing blowing air to an intended direction, and prevents occurrence of dew condensation on two airflow direction louvers configured to adjust a direction of the blowing air in an up-and-down direction.

According to one embodiment of the present invention, there is provided an indoor unit for an air-conditioning apparatus, a casing, which is to be mounted to a wall surface in a room at a back surface side of the casing; an air inlet, which is formed in the casing; an air outlet, which is formed in the casing; an indoor heat exchanger and an indoor fan, which are arranged in an air passage continuous from the air inlet to the air outlet; an up-and-down airflow direction louver, which is arranged in the air outlet to be able to rotate, forms an air outlet passage for blowing air to be blown out through the air outlet at a portion below the air outlet, and is configured to change a direction of the blowing air in the up-and-down direction; and an up-and-down airflow direction auxiliary louver, which is positioned on a front surface side of the casing relative to the up-and-down airflow direction louver, forms the air outlet passage at a position protruding downward from a lower end of the air outlet, and is configured to change the direction of the blowing air in the up-and-down direction, wherein the up-and-down airflow direction louver includes an upstream guide surface, which is positioned on the air outlet passage side, and is configured to guide a flow of the blowing air, and a downstream guide surface, which is positioned on the air outlet passage side and is arranged on a downstream side of the air outlet passage and on an outer side of the air outlet passage relative to the upstream guide surface, and is configured to guide the flow of the blowing air, and wherein the up-and-down airflow direction auxiliary louver includes an upstream end portion, which is positioned on an upstream side of the air outlet passage, the upstream end portion being positioned on an inner side of the air outlet passage relative to the downstream guide surface and being positioned on the upstream side relative to a downstream guide surface distal end portion of the downstream guide surface, which is an end portion of the downstream guide surface on the downstream side of the air outlet passage.

According to one embodiment of the present invention, during a cooling operation of the air-conditioning apparatus, the upstream end portion of the up-and-down airflow direction auxiliary louver is arranged on the inner side of the air outlet passage relative to the downstream guide surface, and the up-and-down airflow direction auxiliary louver and the downstream guide surface are arranged while being overlapped with each other. With this configuration, the blowing air is guided by the air outlet passage formed by the guide surface of the up-and-down airflow direction louver and the up-and-down airflow direction auxiliary louver, which are arranged continuously, to be blown out in a direction toward the front surface of the casing. With this configuration, the air passage resistance of the blowing air can be suppressed. Further, in addition to a main flow of the blowing air blown out in a front direction of the casing, part of the blowing air flows along the guide surface and the downstream guide surface of the up-and-down airflow direction louver, and also flows along a front surface on a side other than the air outlet passage side for the blowing air of the up-and-down airflow direction auxiliary louver provided on the downstream side relative to the up-and-down airflow direction louver. Therefore, the blowing air flows along both the surfaces of the up-and-down airflow direction auxiliary louver, and thus contact of warm and wet indoor air with the lower surface of the up-and-down airflow direction auxiliary louver is prevented, thereby obtaining an effect of preventing dew condensation.

DETAILED DESCRIPTION

Figure 1:
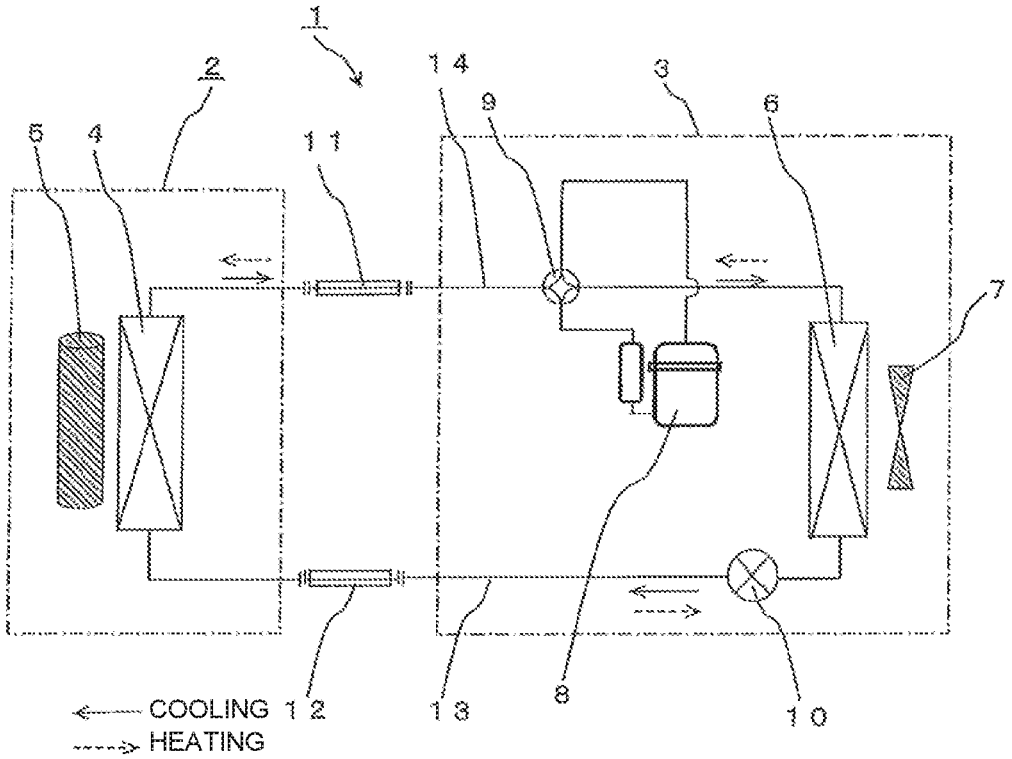
FIG. 1 is a schematic view for illustrating a refrigerant circuit of an air-conditioning apparatus in Embodiment 1 of the present invention.

Now, with reference to the drawings, description is made of an embodiment of the present invention. In the drawings, devices denoted by the same reference symbols are the same or corresponding devices, and the same applies hereinafter. Further, the modes of components described herein are merely illustrative, and the present invention is not limited to those described herein. In particular, combinations of the components are not limited to the combinations in embodiments, and components described in one embodiment may be applied to another embodiment. Further, with regard to a plurality of devices of the same type which are distinguished by suffixes, in a case where the devices are not particularly required to be distinguished or specified, the suffixes are omitted in some cases. In addition, the relationship of sizes of the components in the drawings may differ from the actual sizes.

Embodiment 1

<Configuration of Refrigerant Circuit 13 of Air-Conditioning Apparatus 1>

FIG. 1 is a schematic view for illustrating a refrigerant circuit of an air-conditioning apparatus 1 in Embodiment 1 of the present invention. As illustrated in FIG. 1, in the air-conditioning apparatus 1, there are provided an indoor unit 2 and an outdoor unit 3, which are connected to each other by a gas-side communication pipe 11 and a liquid-side communication pipe 12, thereby constructing a refrigerant circuit 13. The indoor unit 2 includes an indoor heat exchanger 4 therein, and a refrigerant pipe leading to an outside of the indoor unit 2 is connected to the indoor heat exchanger 4. The outdoor unit 3 includes therein a four-way switching valve 9, a compressor 8, an outdoor heat exchanger 6, and an expansion valve 10, which are connected to one another by refrigerant pipes. As described above, in the refrigerant circuit 13, there are provided the indoor heat exchanger 4, the four-way switching valve 9, the compressor 8, the outdoor heat exchanger 6, and the expansion valve 10, which are connected to one another by the refrigerant pipes, thereby constructing a refrigeration cycle. Further, an indoor fan 5 is arranged in the vicinity of the indoor heat exchanger 4, and an outdoor fan 7 is installed in the vicinity of the outdoor heat exchanger 6.

<Configuration of Outdoor Unit 3>

In the outdoor unit 3, there are provided the expansion valve 10, the outdoor heat exchanger 6, and the four-way switching valve 9, which are connected to one another in series by the refrigerant pipes. The four-way switching valve 9 is connected to the outdoor heat exchanger 6, a suction port and a discharge port of the compressor 8, and the refrigerant pipe connected to the gas-side communication pipe 11. The four-way switching valve 9 can switch a heating operation and a cooling operation by switching connection destinations of the discharge port and the suction port. In a case of a passage of the four-way switching valve 9 indicated by the solid lines in FIG. 1, the refrigerant pipe connected to the gas-side communication pipe 11 and the suction port of the compressor 8 are connected to each other, and the discharge port of the compressor 8 and the outdoor heat exchanger 6 are connected to each other. In this case, the air-conditioning apparatus 1 performs the cooling operation. On the other hand, in a case of a passage of the four-way switching valve 9 indicated by the broken lines in FIG. 1, the outdoor heat exchanger 6 and the suction port of the compressor 8 are connected to each other, and the discharge port of the compressor and the refrigerant pipe connected to the gas-side communication pipe 11 are connected to each other. In this case, the air-conditioning apparatus 1 performs the heating operation.

<Configuration of Indoor Unit 2>

Figure 2:
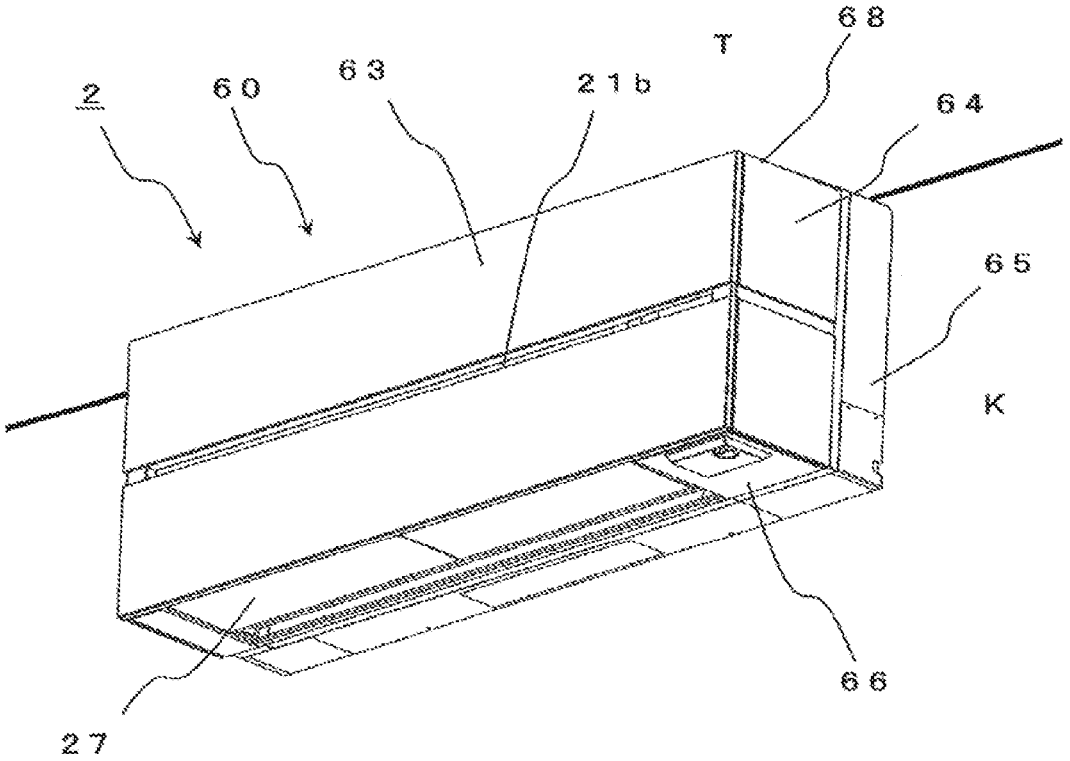
FIG. 2 is a perspective view of an indoor unit for the air-conditioning apparatus according to Embodiment 1 of the present invention.
Figure 3:
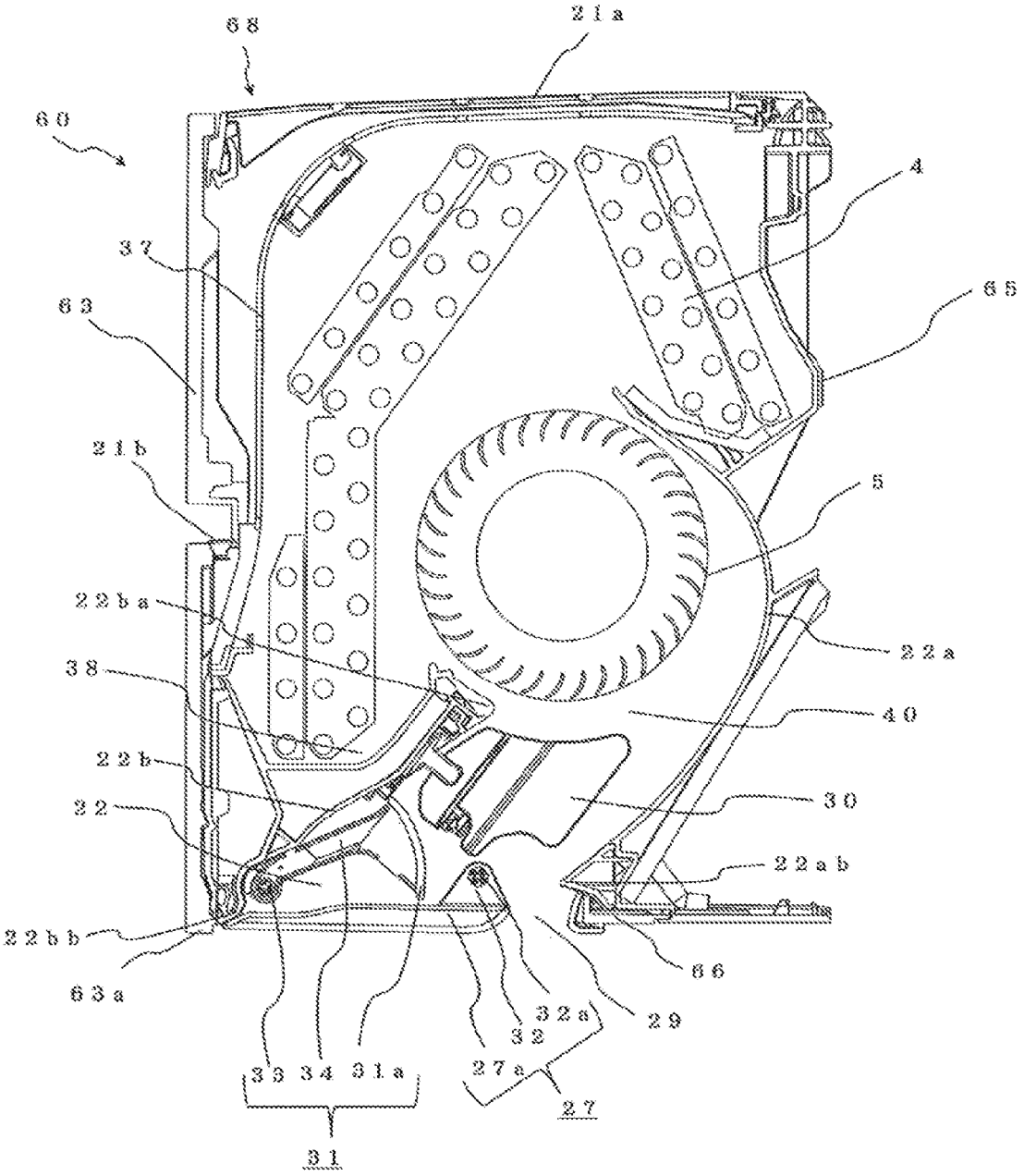
FIG. 3 is an explanatory view for illustrating a cross section perpendicular to a longitudinal direction of the indoor unit of FIG. 2.
Figure 4:
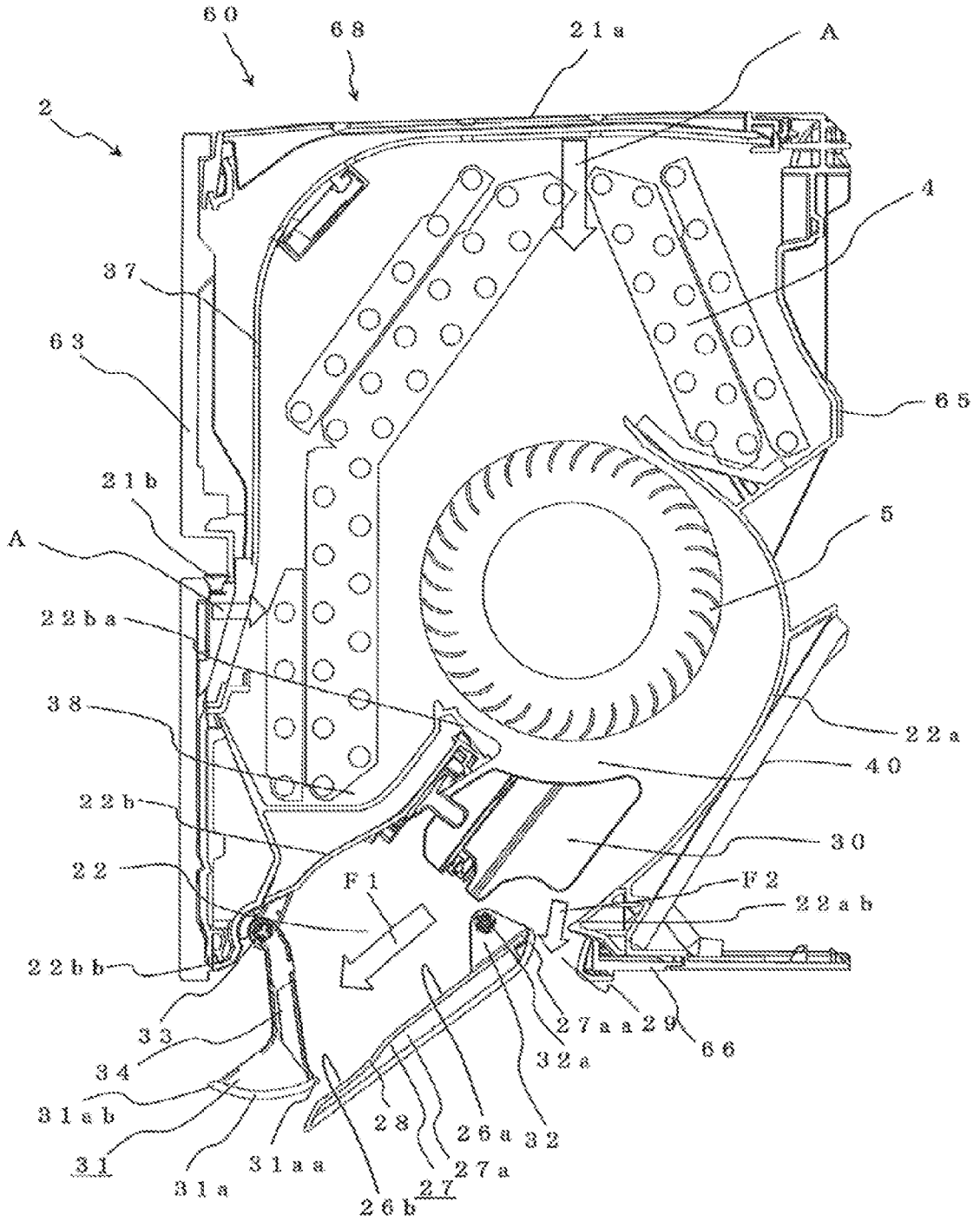
FIG. 4 is an explanatory view for illustrating a cross section perpendicular to the longitudinal direction of the indoor unit of FIG. 2 in an operation state.

FIG. 2 is a perspective view of the indoor unit 2 for the air-conditioning apparatus 1 according to Embodiment 1 of the present invention. FIG. 3 is an explanatory view for illustrating a cross section perpendicular to a longitudinal direction of the indoor unit 2 of FIG. 2. FIG. 4 is an explanatory view for illustrating a cross section perpendicular to the longitudinal direction of the indoor unit 2 of FIG. 2 in the operation state. FIG. 3 is an explanatory view of the indoor unit 2 in an operation stopped state. In FIG. 2, a ceiling surface T is a ceiling surface in a room on which the indoor unit 2 is installed. A wall surface K is a wall surface on which the indoor unit 2 is installed. A surface of the indoor unit 2, which is located on the wall surface K side, is defined as a back surface of the indoor unit 2. Of surfaces constructing the outer appearance of the indoor unit 2, a surface on an opposite side to the back surface, which is opposed to the back surface, is referred to as a front surface. A surface of the indoor unit 2, which is located on the ceiling surface T side, is referred to as a top surface. Of the surfaces constructing the outer appearance of the indoor unit 2, a surface on an opposite side to the top surface, which is opposed to the top surface, is defined as a lower surface. A side surface on the right side in FIG. 2 is defined as a right side surface. A surface on the opposite side to the right side surface, which is opposed to the right side surface, is defined as a left side surface. Further, internal components of the indoor unit 2 are similarly described.

As illustrated in FIG. 2, the indoor unit 2 includes a casing 60 having a horizontally long rectangular parallelepiped shape. In the casing 60, a front surface is covered with a front panel 63, right and left side surfaces are covered with side panels 64, and a back surface is covered with a back panel 65. The front panel 63 is provided in parallel to the wall surface K, and is formed as one flat surface that is flat from the top surface to the lower surface except for a recessed portion being an air inlet 21. Further, a lower end 63*a* of the front panel 63 forms an end portion of the lower surface of the casing 60, which is located on the front surface side. The lower surface is covered with the back panel 65, a lower panel 66, and an up-and-down airflow direction louver 27. The top surface is covered with a top panel 68, and the top panel 68 has a matrix-like opening portion. This opening portion is an air inlet 21*a*. A slit is also formed in the vicinity of a center of the front panel 63 in a height direction of the casing 60, and the slit is an air inlet 21*b*. The lower panel 66 is parallel to a floor surface in a room. The casing 60 of the indoor unit 2 is not limited to the horizontally long rectangular parallelepiped shape, and is not limited only to the shape in FIG. 2 as long as the casing 60 has a box-like shape in which the air inlet 21 for sucking air and an air outlet 22 for blowing out air are each formed at one or more positions. The position and the shape of the air inlet may be set in accordance with needed air volume and design, and the air inlet may be formed only in the top surface, or may be formed only in the front surface. Further, the air outlet 22 is not limited to the mode of opening in a direction right below the casing 60, and may be opened obliquely toward the front surface side of the casing 60.

In a case where the indoor unit 2 has the horizontally long rectangular parallelepiped shape, the air outlet 22 is provided only in the lower surface of the casing 60, and the air outlet is arranged close to the front panel side as in the indoor unit 2 according to Embodiment 1 illustrated in FIG. 2, the air outlet 22 cannot be seen when the indoor unit 2 is seen from the front surface during stop of the operation, thereby being capable enhancing the design. Further, during the operation, the angle at which the air is blown out can be easily directed downward, and thus the air can be caused to reach the floor surface.

As illustrated in FIG. 3, in an inside of the casing 60, the indoor fan 5 configured to generate a flow of air through drive of a motor (not shown) is accommodated. The indoor heat exchanger 4 is arranged in a periphery of a top surface side and a front surface side of the indoor fan 5. An air passage 40 leading to the air outlet 22 is formed below the indoor fan 5. On a front surface wall 22*b* of the air outlet 22, right-and-left airflow direction louvers 30 configured to adjust a right-and-left airflow direction are installed just in front of the air outlet 22 in the air passage 40. An up-and-down airflow direction louver 27 and an up-and-down airflow direction auxiliary louver 31 configured to adjust an up-and-down airflow direction are provided in the air outlet 22. Further, a filter 37 is arranged on an upstream side relative to the indoor heat exchanger 4, and a drain pan 38 is arranged below the indoor heat exchanger 4 so as to collect condensed water generated in the indoor heat exchanger 4.

<Air Passage 40 and Air Outlet 22>

The air passage 40 includes a back surface wall 22*a* on the back surface side, and a front surface wall 22*b* on the front surface side. The back surface wall 22*a* is formed so as to extend downward from a back surface side of the indoor fan 5 to a lower side of the indoor fan 5, thereby leading to the air outlet 22. That is, the back surface wall 22*a* forms an inclined surface from the back surface side of the indoor fan 5 in the direction toward the front surface, and is located so that a terminal end 22*ab* of the back surface wall 22*a* is held in contact with an internal side of the lower panel 66.

Meanwhile, the front surface wall 22*b* of the air outlet 22 has a starting point 22*ba* located directly below the indoor fan 5 and close to the front surface, and extends therefrom obliquely downward toward the front surface side to lead to the air outlet 22. A terminal end 22*bb* of the front surface wall 22*b*, that is, an end portion on the air outlet 22 side is located right behind the lower end 63*a* of the front panel 63 of the indoor unit 2.

Figure 5:
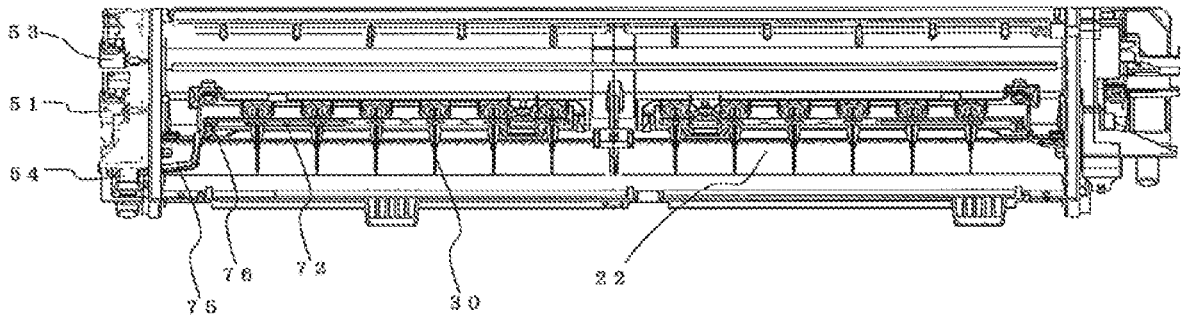
FIG. 5 is a view for illustrating an outer appearance of an air outlet constructing part of the indoor unit of FIG. 1.

FIG. 5 is a view for illustrating an outer appearance of an air outlet constructing part of the indoor unit 2 of FIG. 1. FIG. 5 is an outer appearance view for illustrating a state in which the up-and-down airflow direction louver 27 and the up-and-down airflow direction auxiliary louver 31 are removed from the air outlet constructing part, and is a view as seen from the lower surface side of the indoor unit 2. The plurality of right-and-left airflow direction louvers 30 are installed in the air outlet 22. The plurality of right-and-left airflow direction louvers 30 are coupled to a right-and-left airflow direction louver driving motor 54 by a right-and-left airflow direction louver coupling rod 72, a coupling portion 76, and a right-and-left airflow direction louver driving motor coupling rod 75. The right-and-left airflow direction louver driving motor 54 can change the direction of the right-and-left airflow direction louvers 30 by moving the right-and-left airflow direction louver coupling rod 72 in the right-and-left direction through rotation. An up-and-down airflow direction louver driving motor 51 is configured to rotate the up-and-down airflow direction louver 27. An up-and-down airflow direction auxiliary louver driving motor 53 is configured to drive the up-and-down airflow direction auxiliary louver 31. The up-and-down airflow direction louver 27 and the up-and-down airflow direction auxiliary louver 31 can perform rotating operations independently of each other by the individual motors.

<Up-and-down Airflow Direction Plate 27>

The up-and-down airflow direction louver 27 is mounted to a rotation shaft 32*a*, and is supported to be able to rotate about the rotation shaft 32*a*. The rotation shaft 32*a* is located on the back surface side of the air outlet 22, and is arranged in the vicinity of the back surface wall 22*a* of the air outlet 22 through a gap 29 from the terminal end 22*ab* of the back surface wall 22*a*. Further, the rotation shaft 32*a* is arranged in the inside of the air outlet 22. During the operation, the up-and-down airflow direction louver 27 is opened in a downward direction of the air outlet 22, and the blowing air is blown out through both the air outlet 22 and the gap 29. The up-and-down airflow direction louver 27 and the front surface wall 22*b* in the inside of the air outlet 22 are arranged so as to be opposed to each other, and a space between the opposed plate and wall serves as an air outlet passage for a main flow F1 of the blowing air. The up-and-down airflow direction louver 27 includes a plate-like portion 27*a* extending along a longitudinal direction of the air outlet 22, and a support member 32 protruding from the plate-like portion. The support member 32 is mounted to the rotation shaft 32*a*. The up-and-down airflow direction louver 27 is configured to change the airflow direction of the air to be blown out through the air outlet 22 in the up-and-down direction by moving the plate-like portion 27*a* in the up-and-down direction through intermediation of the up-and-down direction support member 32. As illustrated in FIG. 4, the up-and-down airflow direction louver 27 rotates downward about a rotation shaft 32*a* during the operation to open the air outlet 22, and is adjusted in rotation angle to adjust the up-and-down direction of the air to be blown out. The blowing air to be blown out through the air outlet 22 is referred to as the main flow F1, and the blowing air blown out through the gap 29 is referred to as a sub-flow F2. When the up-and-down airflow direction louver 27 is opened, the up-and-down airflow direction louver 27 guides the main flow F1 of the blowing air at a portion below the air outlet 22.

A surface of the plate-like portion 27*a* of the up-and-down airflow direction louver 27, which is located on the main flow F1 side of the blowing air, has two surfaces for guiding the blowing air, which form the air outlet passage. Of the two surfaces for guiding the blowing air, the surface arranged on an upstream side of the main flow F1 of the blowing air is referred to as an upstream guide surface 26*a*, and the surface arranged on a downstream side of the upstream guide surface 26*a* is referred to as a downstream guide surface 26*b*. The downstream guide surface 26*b* is arranged on the inner side of the air outlet passage relative to the upstream guide surface 26*a*. In the up-and-down airflow direction louver 27, a level difference 28 is formed between the upstream guide surface 26*a* and the downstream guide surface 26*b*. The level difference 28 is formed to have a smooth surface by, for example, an inclined surface, a curved surface, or a combination of the inclined surface and the curved surface. In Embodiment 1, the level difference 28 has an S-shape by connecting curved surfaces having a large curvature so that the blowing air flowing along the upstream guide surface 26*a* is guided to the downstream guide surface 26*b* without being separated from the front surface. The level difference 28 is arranged on a downwind side relative to the center of the plate-like portion 27*a*. Further, the up-and-down airflow direction louver 27 includes a tapered surface 25 at a distal end thereof. The tapered surface 25 is located on a surface of the up-down airflow direction louver 27 on the main flow F1 side of the blowing air, and is smoothly connected to the downstream guide surface 26*b*. In Embodiment 1, the downstream guide surface 26*b* and the tapered surface 25 are connected to each other by a curved surface. In Embodiment 1, the upstream guide surface 26*a* and the downstream guide surface 26*b* have a flat surface. However, the upstream guide surface 26*a* and the downstream guide surface 26*b* may have a curved surface as long as the blowing air can be guided.

The indoor unit 2 illustrated in FIG. 3 is in the operation stopped state, and the up-and-down airflow direction louver 27 covers the air outlet 22. In the operation stopped state of the indoor unit 2, the distal end portion of the plate-like portion 27*a* of the up-and-down airflow direction louver 27 reaches an end on the front surface side of the opening portion of the air outlet 22, that is, the terminal end 22*bb* of the front surface wall 22*b*. The plate-like portion 27*a* of the up-and-down airflow direction louver 27 closes the air outlet 22 so that the inside of the indoor unit 2 cannot be seen. Further, in the operation stopped state, the rotation shaft 32*a* that serves as the center of the rotation of the up-and-down airflow direction louver 27 is arranged on an upper side relative to the plate-like portion 27*a*.

The up-and-down airflow direction louver 27 is turnable about the rotation shaft 32*a* through drive of the up-and-down airflow direction louver driving motor illustrated in FIG. 5 in a range of from an upper structure abutment state (fully-closed state) to a lower structure abutment state (fully-opened state). A distal end of the up-and-down airflow direction louver 27 rotates about the rotation shaft 32*a* along an arcuate locus.

<Up-and-Down Airflow Direction Assist Plate 31>

The front surface wall 22*b* is located on the front surface side of the air outlet 22 and on the upper side relative to the up-and-down airflow direction louver 27. The rotation shaft 33 configured to rotate the up-and-down airflow direction auxiliary louver 31 is arranged in the vicinity of a surface of the front surface wall 22*b* on the air passage side. The rotation shaft 33 is arranged at a position entering the internal side of the casing from the opening portion of the air outlet 22. When the up-and-down airflow direction louver 27 covers the air outlet 22, the rotation shaft 33 is located above the up-and-down airflow direction louver 27. A plate-like portion 31*a* of the up-and-down airflow direction auxiliary louver 31 is formed on a distal end of an arm portion 34 extending from the rotation shaft in a radial direction of rotation. The up-and-down airflow direction auxiliary louver 31 is installed so that a surface of the plate-like portion 31*a* is substantially parallel to a direction along the rotation direction about the rotation shaft 33. That is, the surface of the plate-like portion 31*a* of the up-and-down airflow direction auxiliary louver 31 faces the rotation shaft 33.

The up-and-down airflow direction auxiliary louver 31 is turnable about the rotation shaft 33 in a front-and-rear direction of the casing 60. As illustrated in FIG. 3, in the operation stopped state, the up-and-down airflow direction auxiliary louver 31 is accommodated in the inside of the air outlet 22, and the plate-like portion 31*a* is accommodated so that an end portion thereof is directed downward to close part of the air passage 40. However, as illustrated in FIG. 4, in the operation state, the plate-like portion 31*a* can be positioned so as to be substantially horizontal by causing the entire plate-like portion 31*a* to protrude to a position protruding downward from the lower end of the air outlet 22. Further, the plate-like portion 31*a* of the up-and-down airflow direction auxiliary louver 31 extends along the longitudinal direction of the air outlet 22, that is, the right-and-left direction of the indoor unit 2, and can change the up-and-down airflow direction of the main flow F1 of the blowing air to be blown out through the air outlet 22. The plate-like portion 31*a* of the up-and-down airflow direction auxiliary louver 31 forms the air outlet passage together with the plate-like portion 27*a* of the up-and-down airflow direction louver 27. In Embodiment 1, the plate-like portion 31*a* of the up-and-down airflow direction auxiliary louver 31 has a plate-like shape having a curved surface. However, the plate-like portion 31*a* of the up-and-down airflow direction auxiliary louver 31 may have a flat plate-like shape as long as the blowing air can be guided.

The up-and-down airflow direction auxiliary louver 31 is turnable about the rotation shaft 33 through the drive of the up-and-down airflow direction auxiliary louver driving motor 53 illustrated in FIG. 5 in a range of from a rear structure abutment state being an accommodated state as illustrated in FIG. 3 to a front structure abutment state. The front structure abutment state is a state in which the up-and-down airflow direction auxiliary louver 31 is further rotated toward the front side from the position of the up-and-down airflow direction auxiliary louver 31 illustrated in FIG. 4 so that the arm portion 34 is brought into abutment against the terminal end 22*bb* of the front surface wall 22*b*. A distal end of the up-and-down airflow direction auxiliary louver 31 rotates about the rotation shaft 33 along an arcuate locus.

<Positional Relationship Between Up-and-Down Airflow Direction Plate 27 and Up-and-down Airflow Direction Assist Plate 31>

As illustrated in FIG. 3 and FIG. 4, the rotation shaft 33 of the up-and-down airflow direction auxiliary louver 31 is located on the front side in the inside of the air outlet 22, and the rotation shaft 32*a* of the up-and-down airflow direction louver 27 is located on the back surface side in the inside of the air outlet 22. As illustrated in FIG. 3, in the operation stopped state, the up-and-down airflow direction louver 27 covers the air outlet 22 under a state in which the plate-like portion 27*a* is horizontal. Further, the entire up-and-down airflow direction auxiliary louver 31 is accommodated in the inside of the air outlet 22 by moving the plate-like portion 31*a* toward the back surface side. In the operation stopped state, the up-and-down airflow direction auxiliary louver 31 is arranged above the up-and-down airflow direction louver 27, and the rotation shaft 33 is located above the distal end of the up-and-down airflow direction louver 27. Further, the plate-like portion 31*a* of the up-and-down airflow direction auxiliary louver 31 is positioned on the front side relative to the rotation shaft 32*a* of the up-and-down airflow direction louver 27 and above the plate-like portion 27*a* of the up-and-down airflow direction louver 27. In the operation stopped state, as described above, the up-and-down airflow direction louver 27 and the up-and-down airflow direction auxiliary louver 31 are accommodated in the air outlet 22. Thus, dust in a room does not accumulate.

The distal end of the up-and-down airflow direction louver 27 is rotated from the front surface side of the casing 60 toward the back surface side thereof from the operation stopped state as described above, to thereby open the air outlet 22. The up-and-down airflow direction auxiliary louver 31 is rotated with its distal end being oriented form the back surface side of the casing 60 to the front surface side thereof after the up-and-down airflow direction louver 27 rotates to a position not crossing the arcuate locus of the rotation of the up-and-down airflow direction auxiliary louver 31. The locus of the rotation of the up-and-down airflow direction louver 27 and the locus of the rotation of the up-and-down airflow direction auxiliary louver 31 cross each other. Thus, during the opening and closing operations of the air outlet 22 or an operation of changing the airflow direction, it is required that the up-and-down airflow direction louver 27 and the up-and-down airflow direction auxiliary louver 31 be operated while preventing contact therebetween. However, with this configuration, the blowing air can be freely adjusted in the up-and-down direction while accommodating the two airflow direction louvers in a small space, and further, a large air outlet passage can be secured during the operation of the indoor unit 2.

<Flow of Air in Indoor Unit 2 according to Embodiment 1>

Now, with reference to FIG. 3 and FIG. 4, a flow of air in the indoor unit 2 is described. The arrows A illustrated in the vicinities of the air inlet 21*a* and the air inlet 21*b* illustrated in FIG. 4 each indicate a flow of air taken into the indoor unit 2 through the air inlet. The air sucked through the air inlets 21 arranged in the top surface and the front surface of the indoor unit 2 is subjected to heat exchange with refrigerant flowing through the indoor heat exchanger 4 when the air passes through the indoor heat exchanger 4. The air passing through the indoor heat exchanger 4 is cooled during the cooling operation of the air-conditioning apparatus 1, or is heated during the heating operation of the air-conditioning apparatus 1. The conditioned air having passed through the indoor heat exchanger 4 and having been subjected to heat exchange with the refrigerant flows to the indoor fan 5. The air having passed through the indoor fan 5 or a gap between the indoor fan 5 and the back panel 65 passes through the air passage 40, and is adjusted in the right-and-left direction by the airflow direction louvers 30. The air having passed through the airflow direction louvers 30 is blown out frontward or downward from the indoor unit 2 through the air outlet 22 along the up-and-down airflow direction louver 27 and the up-and-down airflow direction auxiliary louver 31 installed in the air outlet 22.

When the indoor unit 2 is in the operation state, the up-and-down airflow direction louver 27 rotates about the rotation shaft 32*a* arranged in the vicinity of the lower end of the opening of the air outlet 22 to move the distal end toward the lower side of the air outlet 22 so that the distal end is directed obliquely in the downward direction of the indoor unit 2. The plate-like portion 27*a* of the up-and-down airflow direction louver 27 is arranged at a position close to the rotation shaft 32*a*. Thus, even under a state in which the up-and-down airflow direction louver 27 rotates to open the air outlet 22, an upstream end portion 27*aa* of the plate-like portion 27*a* is positioned in the opening portion of the air outlet 22. Therefore, the plate-like portion 27*a* of the up-and-down airflow direction louver 27 protrudes obliquely in the downward direction of the casing 60 with the opening portion of the air outlet 22 being the starting point. The up-and-down airflow direction auxiliary louver 31 rotates about the rotation shaft 33 arranged in the vicinity of the lower end of the opening of the air outlet 22 from the state of being accommodated in the air outlet 22 illustrated in FIG. 3, protrudes downward from the air outlet 22, and is arranged so that the plate-like portion 31*a* for guiding the blowing air is substantially horizontal. The plate-like portion 31*a* of the up-and-down airflow direction auxiliary louver 31 is provided at the position farther from the rotation shaft 33. Thus, when the up-and-down airflow direction auxiliary louver 31 is rotated by a predetermined angle, an upstream end portion 31*aa* and a downstream end portion 31*ab* of the plate-like portion 31*a* are caused to move to the positions protruding from the opening portion of the air outlet 22. With this configuration, the plate-like portion 31*a* of the up-and-down airflow direction auxiliary louver 31 can be positioned on the front surface side of the casing 60 in the vicinity of the distal end of the up-and-down airflow direction louver 27. That is, the plate-like portion 27*a* of the up-and-down airflow direction louver 27 is positioned on the upstream side of the air outlet passage, and the plate-like portion 31*a* of the up-and-down airflow direction auxiliary louver 31 is positioned on the downstream side of the air outlet passage. In this manner, the up-and-down airflow direction louver 27 and the up-and-down airflow direction auxiliary louver 31 are arranged continuously from the opening portion of the air outlet 22, thereby forming the air outlet passage. The blowing air is guided by the up-and-down airflow direction louver 27 and the up-and-down airflow direction auxiliary louver 31 to be blown out toward the front surface side of the casing 60. As the plate-like portion 31*a* protrudes from the air outlet 22 to increase a distance from the terminal end 22*bb* of the front surface wall 22*b* of the air passage in the inside of the air outlet 22, the area of the air outlet passage is increased, thereby being capable of reducing the air passage resistance when an airflow in a horizontal direction is generated.

The up-and-down airflow direction louver 27 can be stopped not only at the angle illustrated in FIG. 4 but also at respective angles from the state of closing the air outlet 22 as illustrated in FIG. 3 to a state in which the distal end is directed in the direction right below the casing 60. The up-and-down airflow direction auxiliary louver 31 can also be turned at respective angles from the state of being accommodated in the inside of the air outlet 22 as illustrated in FIG. 3 to the state of being substantially horizontal as illustrated in FIG. 4. The up-and-down airflow direction louver 27 and the up-and-down airflow direction auxiliary louver 31 are provided to be able to turn as described above. Thus, during the operation, the angle at which the air is blown out can be directed not only downward but also frontward. In the case of the positions of the up-and-down airflow direction louver 27 and the up-and-down airflow direction auxiliary louver 31 illustrated in FIG. 4, the indoor unit 2 is in a state of blowing out air frontward. The main flow F1 of the blowing air is guided by the upstream guide surface 26*a* and the downstream guide surface 26*b* of the up-and-down airflow direction louver 27 and the plate-like portion 31*a* of the up-and-down airflow direction auxiliary louver 31, to thereby be blown out in the direction toward the front surface of the indoor unit 2.

Figure 6:
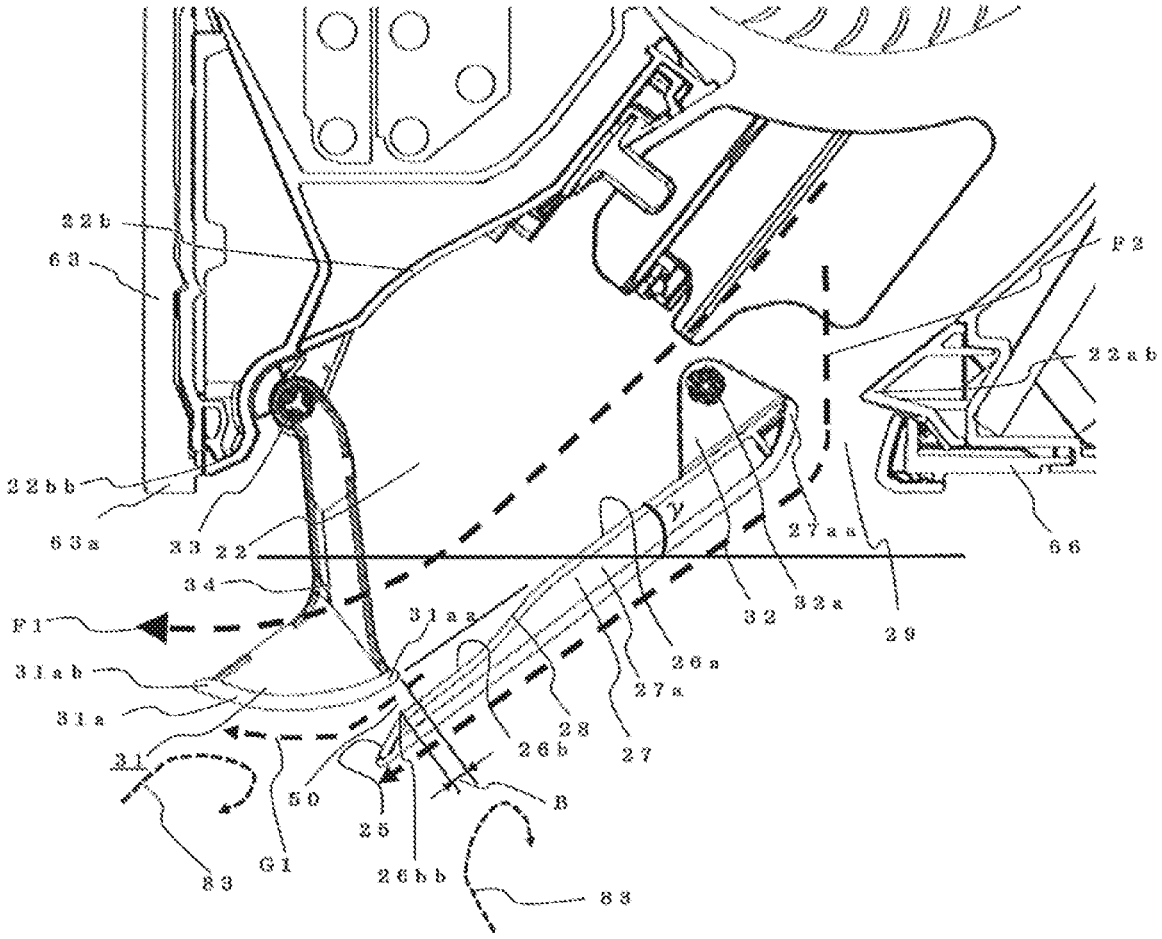
FIG. 6 is an enlarged view of a periphery of an air outlet of FIG. 4.

FIG. 6 is an enlarged view of a periphery of the air outlet 22 of FIG. 4. The plate-like portion 27*a* of the up-and-down airflow direction louver 27 is opened at an angle γ relative to the horizontal direction. After the blowing air passes through the airflow direction louvers 30, the blowing air is separated into the main flow F1, which is guided by the surface on the upper side of the up-and-down airflow direction louver 27, that is, the surface facing the inside of the casing during stop of the operation to be changed in the airflow direction, and the sub-flow F2, which is to flow out through the gap 29 between the terminal end 22*ab* of the back surface wall 22*a* and a periphery portion of the rotation shaft 32*a* of the up-and-down airflow direction louver 27. After the sub-flow F2 flows out from the indoor unit 2 through the gap 29, due to the Coanda effect, the sub-flow F2 flows along the surface on the outer side of the up-and-down airflow direction louver 27, that is, a surface on a side serving as a design surface when the air outlet 22 is closed during stop of the operation. Meanwhile, the main flow F1 is blown onto the upstream guide surface 26*a* of the up-and-down airflow direction louver 27 so that the airflow direction of the main flow F1 is changed to the direction along the front surfaces of the upstream guide surface 26*a* and the downstream guide surface 26*b*. The main flow F1 changed in the flow direction passes above the plate-like portion 31*a* of the up-and-down airflow direction auxiliary louver 31, which is directed substantially horizontally, and is blown out in the direction toward the front surface of the indoor unit 2. The downstream guide surface 26*b* of the up-and-down airflow direction louver 27 and the plate-like portion 31*a* of the up-and-down airflow direction auxiliary louver 31 are arranged with a gap 50 therebetween so that the blowing air flows in a direction in which the distal end of the up-and-down airflow direction louver 27 is directed. After part of the main flow F1 flowing along the front surface of the up-and-down airflow direction louver 27 flows along the downstream guide surface 26*b*, the part of the main flow F1 flows through the gap 50 as a sub-flow G1. Due to the Coanda effect, the sub-flow G1 flowing through the gap 50 flows along a surface on a lower side of the plate-like portion 31*a* of the up-and-down airflow direction auxiliary louver 31, that is, a surface on a side not facing the rotation shaft 33.

At this time, the upstream end portion 31*aa* of the plate-like portion 31*a* of the up-and-down airflow direction auxiliary louver 31 is positioned on the upstream side relative to a downstream guide surface distal end portion 26*bb* being an end portion of the downstream guide surface 26*b* on the downstream side. That is, the plate-like portion 31*a* of the up-and-down airflow direction auxiliary louver 31 and the downstream guide surface 26*b* are overlapped with each other by a dimension B illustrated in FIG. 6 in the flow direction of the blowing air. Further, a tangent line to the surface on the lower side of the plate-like portion 31*a* of the up-and-down airflow direction auxiliary louver 31 at the upstream end portion 31*aa* is substantially parallel to the downstream guide surface 26*b*. With this configuration, the sub-flow G1 flowing through the gap 50 is likely to flow along the lower surface of the plate-like portion 31*a* of the up-and-down airflow direction auxiliary louver 31. Further, the upstream end portion 31*aa* of the plate-like portion 31*a* of the up-and-down airflow direction auxiliary louver 31 is positioned on an imaginary plane that is obtained by extending the upstream guide surface 26*a* in a downstream direction of the air outlet passage. With this configuration, the main flow F1 of the blowing air flows through the air outlet passage formed by the up-and-down airflow direction louver 27 and the up-and-down airflow direction auxiliary louver 31, thereby preventing the sub-flow G1 from flowing through the gap 50 at an unnecessarily high rate.

As described above, the sub-flow F2 and the sub-flow G1 respectively flow along the surfaces of the up-and-down airflow direction louver 27 and the up-and-down airflow direction auxiliary louver 31, which are on the opposite side to the surfaces on the side facing the main flow F1, thereby being capable of preventing occurrence of a temperature difference in air between both the surfaces of each of the plate-like portion 27*a* of the up-and-down airflow direction louver 27 and the plate-like portion 31*a* of the up-and-down airflow direction auxiliary louver 31. That is, when the indoor unit 2 for the air-conditioning apparatus performs the cooling operation, contact of warm and wet indoor air 83 with the plate-like portion 27*a* of the up-and-down airflow direction louver 27 and the plate-like portion 31*a* of the up-and-down airflow direction auxiliary louver 31 can be prevented, thereby being capable of preventing occurrence of dew condensation on the up-and-down airflow direction louver 27 and the up-and-down airflow direction auxiliary louver 31.

<Flow of Air in Indoor Unit 2 in Comparative Example>

Figure 7:
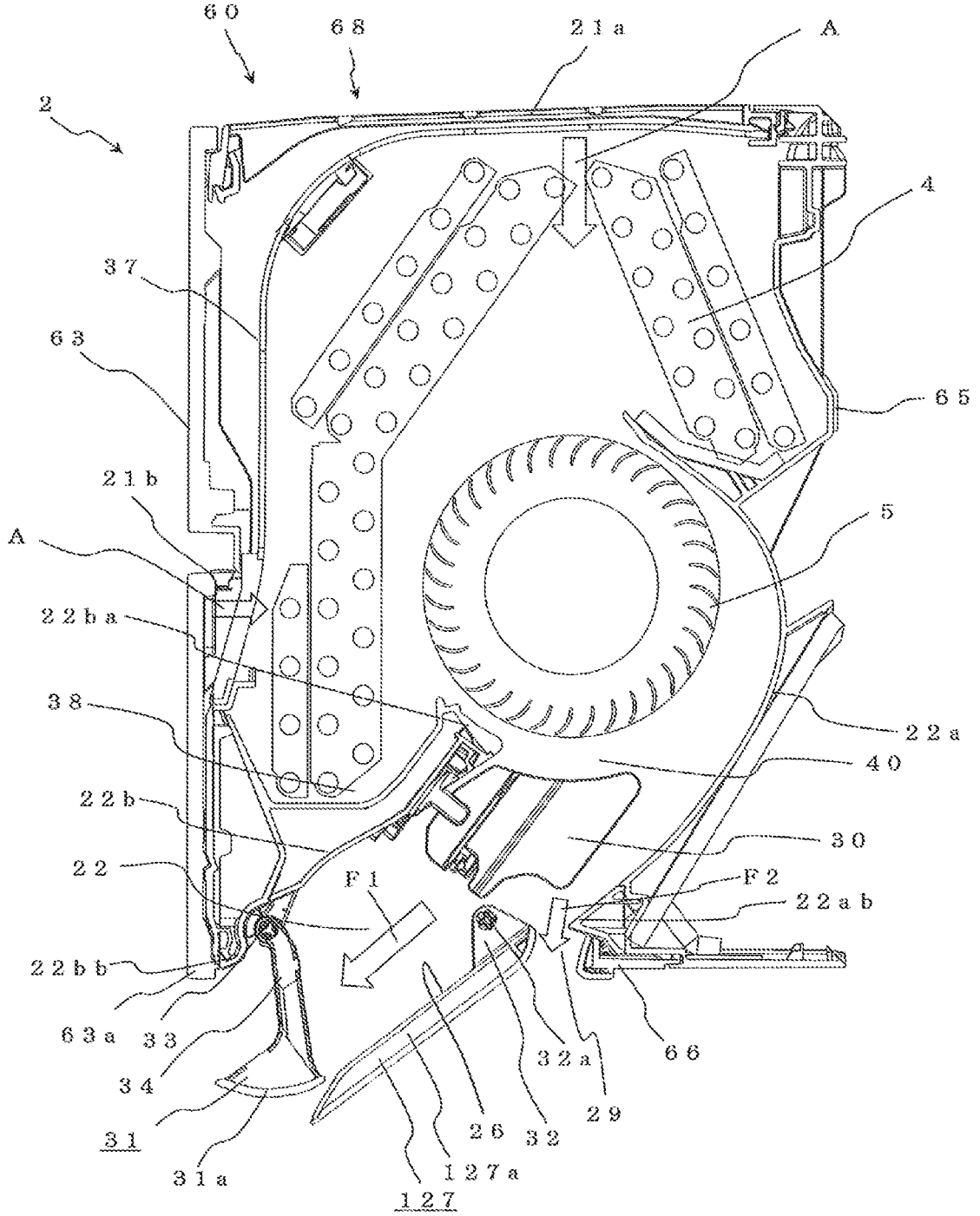
FIG. 7 is an explanatory view for illustrating a cross section of a comparative example in which a shape of a plate-like portion of an up-and-down airflow direction louver is changed from that of the indoor unit of FIG. 4.
Figure 8:
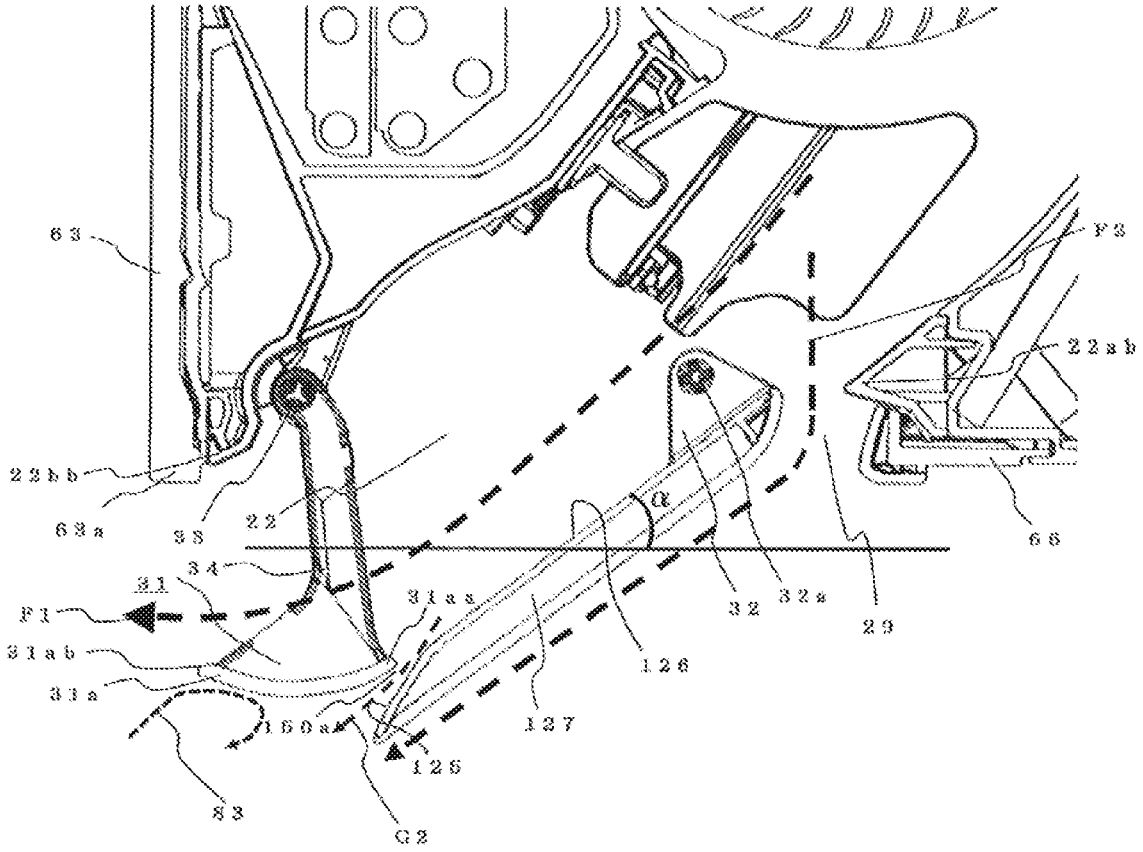
FIG. 8 is an enlarged view of a periphery of the air outlet 22 of FIG. 7.

FIG. 7 is an explanatory view for illustrating a cross section of a comparative example in which the shape of the plate-like portion 27*a* of the up-and-down airflow direction louver 27 is changed from that of the indoor unit 2 of FIG. 4. FIG. 8 is an enlarged view of a periphery of the air outlet 22 of FIG. 7. In the comparative example illustrated in FIG. 7 and FIG. 8, only the shape of the plate-like portion 27*a* of the up-and-down airflow direction louver 27 is different from that of the indoor unit 2 according to Embodiment 1. As illustrated in FIG. 7, an up-and-down airflow direction louver 127 in the comparative example includes a guide surface 126 and a tapered surface 125 on the main flow F1 side of the blowing air. The tapered surface 125 is located on a distal end side of the up-and-down airflow direction louver 127, and is smoothly connected to the guide surface 126. Unlike Embodiment 1, the up-and-down airflow direction louver 127 does not include the downstream guide surface 26*b* and the level difference 28. Similarly to Embodiment 1, the air having passed through the indoor heat exchanger 4 to be conditioned passes through the air passage 40, and is adjusted in the right-and-left direction by the airflow direction louvers 30. The air having passed through the airflow direction louvers 30 is blown out frontward or downward from the indoor unit 2 through the air outlet 22 along the up-and-down airflow direction louver 127 and the up-and-down airflow direction auxiliary louver 31 installed in the air outlet 22.

Similarly to Embodiment 1, when the indoor unit 2 is in the operation state, the up-and-down airflow direction louver 127 rotates about the rotation shaft 32*a* to move a distal end of the up-and-down airflow direction louver 127 toward the lower side of the air outlet 22. Similarly to Embodiment 1, the up-and-down airflow direction auxiliary louver 31 also rotates about the rotation shaft 33, protrudes downward from the air outlet 22, and is caused to move so that the plate-like portion 31*a* for guiding the blowing air is substantially horizontal, that is, an imaginary line that is obtained by connecting the downstream end portion 31*ab* and the upstream end portion 31*aa* is substantially horizontal. The blowing air is guided by the up-and-down airflow direction louver 127 and the up-and-down airflow direction auxiliary louver 31 to be blown out toward the front surface side of the casing 60. In the case of the positions of the up-and-down airflow direction louver 27 and the up-and-down airflow direction auxiliary louver 31 illustrated in FIG. 7, the indoor unit 2 is in a state of blowing out air frontward. The main flow F1 of the blowing air is guided by the guide surface 126 of the up-and-down airflow direction louver 127 and the plate-like portion 31*a* of the up-and-down airflow direction auxiliary louver 31, to thereby be blown out in the direction toward the front surface of the indoor unit 2.

As illustrated in FIG. 8, after the blowing air passes through the airflow direction louvers 30, the blowing air is separated into the main flow F1, which is to be guided by a surface on the upper side of the up-and-down airflow direction louver 127, that is, the guide surface 126 being the surface facing the inside of the casing during stop of the operation to be changed in the airflow direction, and the sub-flow F2, which is to flow out through the gap 29 between the terminal end 22*ab* of the back surface wall 22*a* and the periphery portion of the rotation shaft 32*a* of the up-and-down airflow direction louver 127. After the sub-flow F2 flows out from the indoor unit 2 through the gap 29, due to the Coanda effect, the sub-flow F2 flows along the surface on the outer side of the up-and-down airflow direction louver 127, that is, a surface on a side serving as a design surface during stop of the operation. The main flow F1 is blown onto the guide surface 126 of the up-and-down airflow direction louver 127 so that the airflow direction of the main flow F1 is changed to the direction along the front surface of the guide surface 126. The main flow F1 changed in the flow direction passes above the plate-like portion 31*a* of the up-and-down airflow direction auxiliary louver 31, which is directed substantially horizontally, and is blown out in the direction toward the front surface of the indoor unit 2. The tapered surface 125 of the up-and-down airflow direction louver 127 and the plate-like portion 31*a* of the up-and-down airflow direction auxiliary louver 31 are arranged with a gap 150*a* therebetween so that part of the air of the main flow F1 flows through the gap 150*a*. However, in FIG. 8, the upstream end portion 31*aa* of the plate-like portion 31*a* of the up-and-down airflow direction auxiliary louver 31 is positioned on an imaginary plane that is obtained by extending the guide surface 126 of the up-and-down airflow direction louver in the downstream direction of the air outlet passage, and thus the gap 150*a* is narrow. With this configuration, an amount of a sub-flow G2 flowing out through the gap 150*a* is small. Further, the air passage formed by the tapered surface 125 and the plate-like portion 31*a* of the up-and-down airflow direction auxiliary louver 31 has a shape increased from the upstream side to the downstream side. Thus, the sub-flow G2 is less likely to flow along the surface on the lower side of the plate-like portion 31*a* of the up-and-down airflow direction auxiliary louver 31. With this configuration, the contact of the warm and wet indoor air 83 with the surface on the lower side of the plate-like portion 31*a* of the up-and-down airflow direction auxiliary louver 31, which is cooled by the blowing air during the cooling operation, is liable to occur. Thus, dew condensation is liable to occur.

Figure 9:
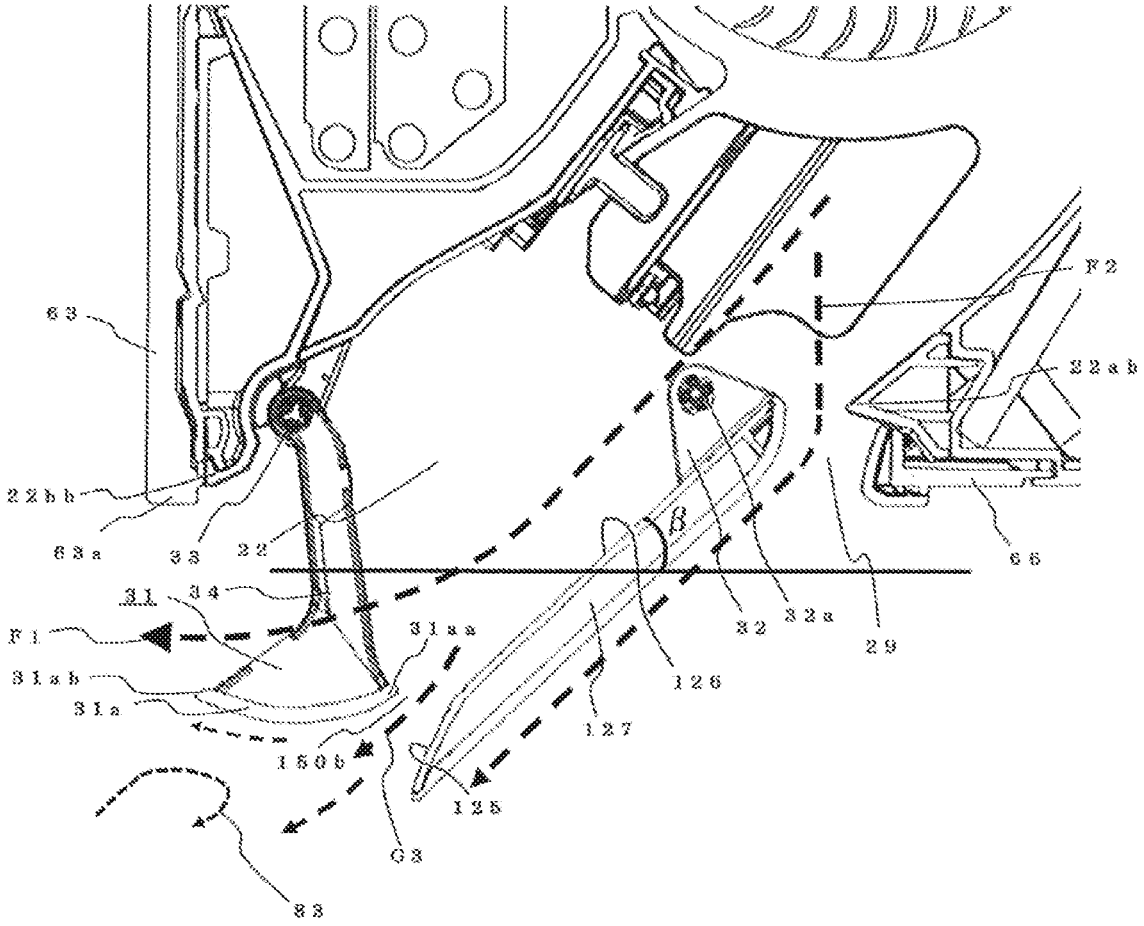
FIG. 9 is a view for illustrating a state in which an angle of the up-and-down airflow direction louver is changed from that of FIG. 8.

FIG. 9 is a view for illustrating a state in which the angle of the up-and-down airflow direction louver 127 is changed from that of FIG. 8. In FIG. 9, the up-and-down airflow direction louver 127 is opened in the downward direction as compared to FIG. 8. An angle formed by the up-and-down airflow direction louver 127 and the horizontal direction is an angle $\alpha$ in FIG. 8 and an angle $\beta$ in FIG. 9. The relationship between the angle $\alpha$ and the angle $\beta$ is $\alpha<\beta$. In the positional relationship between the up-and-down airflow direction louver 127 and the up-and-down airflow direction auxiliary louver 31 illustrated in FIG. 9, a gap 150*b* is larger than the gap 150*a* in FIG. 8, and hence the air volume of a sub-flow G3 flowing out through the gap 150*b* is larger than that in the state in FIG. 8. With this configuration, the contact of the indoor air 83 with the surface on the lower side of the plate-like portion 31*a* of the up-and-down airflow direction auxiliary louver 31 can be prevented, thereby being capable of preventing occurrence of dew condensation on the up-and-down airflow direction auxiliary louver 31. However, the upstream end portion 31*aa* of the plate-like portion 31*a* of the up-and-down airflow direction auxiliary louver 31 is not positioned on the imaginary plane that is obtained by extending the guide surface 126 of the up-and-down airflow direction louver in the downstream direction of the air outlet passage. With this configuration, the flow rate of the sub-flow G3 is high. Moreover, the sub-flow G3 is blown out to a room at an angle that is close to the angle $\beta$ of the up-and-down airflow direction louver 127, and hence the sub-flow G3 is directly blown onto a person in the room. The sub-flow G3, which is different from the main flow F1, flows in the room. As a result, the person onto which the sub-flow G3 is blown has a feeling of draft, which may be a cause of a trouble.

In the operation state illustrated in FIG. 6, the angle of the up-and-down airflow direction louver 27 in Embodiment 1 forms the angle $\gamma$ relative to the horizontal direction. The angle $\gamma$ is an angle equal to the above-mentioned angle $\alpha$ in FIG. 8. Therefore, in the operation state illustrated in FIG. 6, the angle of the up-and-down airflow direction louver 27 is set smaller than the angle $\beta$ of the up-and-down airflow direction louver 127 in the comparative example illustrated in FIG. 9. Consequently, the sub-flow G1 is less liable to be blown onto a person in a room, thereby being capable of preventing the feeling of draft from being given to the person in the room.

<Effect of Embodiment>

As described above, in the case of the shape of the up-and-down airflow direction louver 127 illustrated in FIG. 7 to FIG. 9, it is difficult to cause the blowing air to flow along the surface on the lower side of the up-and-down airflow direction auxiliary louver 31 due to the Coanda effect while the flow rate of the sub-flow G3 is set to such a degree that may not affect a person in a room. Therefore, in Embodiment 1, the indoor unit 2 for the air-conditioning apparatus 1 includes the casing 60, which is mounted to the wall surface K in a room at the back surface side, the air inlets 21, which are formed in the casing 60, the air outlet 22, which is formed in the casing 60, the indoor heat exchanger 4 and the indoor fan 5, which are arranged in the air passage continuous from the air inlets 21 to the air outlet 22, the up-and-down airflow direction louver 27, which is arranged in the air outlet 22 to be able to turn, forms the air outlet passage for the blowing air to be blown out through the air outlet 22 at the position protruding downward from the lower end of the air outlet 22, and is configured to change the direction of the blowing air in the up-and-down direction, and the up-and-down airflow direction auxiliary louver 31, which is positioned on the front surface side of the casing 60 relative to the up-and-down airflow direction louver 27 in the air outlet 22, forms the air outlet passage at the portion below the air outlet 22, and is configured to change the direction of the blowing air in the up-and-down direction. The up-and-down airflow direction louver 27 includes the upstream guide surface 26*a*, which is positioned on the air outlet passage side, and is configured to guide the flow of the blowing air, and the downstream guide surface 26*b*, which is positioned on the air outlet passage side and is arranged on the downstream side of the air outlet passage and on the outer side of the air outlet passage relative to the upstream guide surface 26*a*, and is configured to guide the flow of the blowing air. The upstream end portion 31*aa*, which is positioned on the upstream side of the air outlet passage in the up-and-down airflow direction auxiliary louver 31, is positioned on the inner side of the air outlet passage relative to the downstream guide surface 26*b*, and is positioned on the upstream side relative to the downstream guide surface distal end portion 26*bb*, which is the end portion of the downstream guide surface 26*b* on the downstream side of the air outlet passage.

With this configuration, in the indoor unit 2 for the air-conditioning apparatus 1, the main flow F1 of the blowing air can be directed to the intended direction while suppressing the air passage resistance, and further, part of the blowing air can be caused to flow along the surface on the lower side of the up-and-down airflow direction auxiliary louver 31. Further, the downstream guide surface 26*b* and the up-and-down airflow direction auxiliary louver 31 are positioned while being overlapped with each other. Thus, due to the Coanda effect, the sub-flow G1 flowing through the gap 50 between the downstream guide surface 26*b* and the up-and-down airflow direction auxiliary louver 31 is likely to flow along the surface on the lower side of the up-and-down airflow direction auxiliary louver 31. Therefore, also when the air-conditioning apparatus 1 performed the cooling operation, the contact of the indoor air 83 with the up-and-down airflow direction auxiliary louver 31 having been cooled is prevented, thereby being capable of preventing occurrence of dew condensation on the lower surface of the plate-like portion 31*a* of the up-and-down airflow direction auxiliary louver 31. Further, the sub-flow G1 can be caused to flow along the lower surface of the up-and-down airflow direction auxiliary louver 31 without increasing the volume of air caused to flow through the gap 50, thereby being capable of preventing the feeling of draft from being given to the person in the room.

In the indoor unit 2 for the air-conditioning apparatus 1 according to Embodiment 1, in the up-and-down airflow direction auxiliary louver 31, the upstream end portion 31*aa* on the air outlet passage side is positioned on the imaginary plane that is obtained by extending the upstream guide surface 26*a* of the up-and-down airflow direction louver 27 toward the downstream side of the flow of the blowing air. Further, the upstream end portion 31*aa* of the up-and-down airflow direction auxiliary louver 31 is positioned at a predetermined distance from the upstream guide surface 26*a* toward the downstream side of the air outlet passage. Further, the downstream guide surface 26*b* and the upstream guide surface 26*a* are connected to each other by the curved surface.

With this configuration, in addition to the above-mentioned effect, the main flow F1 of the blowing air, which is guided by the upstream guide surface 26*a*, is blown out in the intended direction by the plate-like portion 31*a* of the up-and-down airflow direction auxiliary louver 31. Further, the blowing air flowing along the front surface of the upstream guide surface 26*a* continuously flows along the downstream guide surface 26*b* through the level difference 28, thereby being capable of causing the sub-flow G1 to efficiently flow along the lower surface of the up-and-down airflow direction auxiliary louver 31 without unnecessarily increasing the flow rate. With this configuration, the feeling of draft is prevented from being given to the person in the room.

In the indoor unit 2 for the air-conditioning apparatus 1 according to Embodiment 1, the tangent line to the upstream end portion 31*aa* of the up-and-down airflow direction auxiliary louver 31 in the direction along the air outlet passage is parallel to the downstream guide surface 26*b*. Further, the up-and-down airflow direction auxiliary louver 31 is arranged at a predetermined distance from the downstream guide surface 26*b*.

With this configuration, due to the Coanda effect, the sub-flow G1 flowing through the gap 50 between the downstream guide surface 26*b* and the up-and-down airflow direction auxiliary louver 31 is more likely to flow along the surface on the lower side of the up-and-down airflow direction auxiliary louver 31. Therefore, the effect of preventing dew condensation that may occur on the lower surface of the plate-like portion 31*a* of the up-and-down airflow direction auxiliary louver 31 can further be enhanced.

In the indoor unit 2 for the air-conditioning apparatus 1 according to Embodiment 1, the downstream end portion 31*ab* of the up-and-down airflow direction auxiliary louver 31, which is positioned in the downstream side of the air outlet passage, is directed to the direction toward the front surface of the casing. With this configuration, the above-mentioned effect can be obtained even under a state in which the main flow F1 of the blowing air is blown out horizontally in the front surface direction.

In the indoor unit 2 for the air-conditioning apparatus 1 according to Embodiment 1, in the up-and-down airflow direction louver 27 and the up-and-down airflow direction auxiliary louver 31, the rotation shafts 32*a* and 33 that each serve as the center of the rotation are arranged in the inside of the air outlet 22. The up-and-down airflow direction auxiliary louver 31 includes the plate-like portion 31*a*, which is configured to guide the blowing air, and forms the air outlet passage. The plate-like portion 31*a* is positioned so as to protrude downward from the air outlet 22. Further, the up-and-down airflow direction auxiliary louver 31 is accommodated in the inside of the air outlet 22 during stop of the operation. Further, the up-and-down airflow direction louver 27 covers the air outlet 22 during stop of the operation. Further, the air outlet 22 is opened at the lower surface of the casing 60, and the up-and-down airflow direction auxiliary louver 31 protrudes from the air outlet.

With this configuration, in the air-conditioning apparatus 1 in which the casing 60 has a rectangular parallelepiped shape, and the air outlet 22 is opened at the lower surface, the above-mentioned effects can be obtained. In particular, the plate-like portion 31*a* of the up-and-down airflow direction auxiliary louver 31 is positioned so as to protrude from the air outlet 22, and thus a large air outlet passage can be secured, thereby being capable of obtaining an effect of further reducing the air passage resistance.

The invention claimed is:

1. An indoor unit for an air-conditioning apparatus, the indoor unit comprising:

a casing, a back surface of which is to be mounted to a wall surface in a room;

an air inlet, which is formed in the casing;

an air outlet, which is formed in the casing;

an indoor heat exchanger and an indoor fan, which are arranged in an air passage, which is continuous from the air inlet to the air outlet;

an up-and-down airflow direction louver, which is arranged in the air outlet, is able to rotate, and is configured to change a direction of blowing air in an up-and-down direction; and an up-and-down airflow direction auxiliary louver, which is configured to, at a position on a front surface side of the casing, change the direction of the blowing air in the up-and-down direction, wherein the up-and-down airflow direction louver includes an upstream guide surface, which is configured to guide a flow of the blowing air, and a downstream guide surface, which is arranged on a downstream side of the blowing air and below the upstream guide surface, and is configured to guide the blowing air, and a level difference between the upstream guide surface and the downstream guide surface, when the blowing air blows to the front of the casing, the up-and-down airflow direction louver is open in a downward direction of the air outlet and forms an air outlet passage of the blowing air, and the up-and-down airflow direction auxiliary louver is positioned in a frontward direction of the casing relative to the up-and-down airflow direction louver and forms the air outlet passage together with the up-and-down airflow direction louver, the up-and-down airflow direction auxiliary louver includes an upstream end portion, which is positioned on an upstream side of the air outlet passage, the upstream end portion is positioned above the downstream guide surface, upstream of an end portion of the downstream guide surface and downstream of the level difference, the level difference is a curved step, which has an upstream end that is continuous with the upstream guide surface and a downstream end that is continuous with the downstream guide surface, the downstream end of the level difference is upstream of the upstream end portion, and the upstream guide surface of the up-and-down airflow direction louver is coupled to a first rotation shaft so that the downstream guide surface is farther from the rotation shaft than the upstream guide surface, the up-and-down airflow direction auxiliary louver is coupled to and rotates about a second rotation shaft, and a distance between the upstream guide surface and the first rotation shaft is less than a distance between the upstream end portion and the second rotation shaft.

2. The indoor unit for an air-conditioning apparatus of claim 1, wherein, in the up-and-down airflow direction auxiliary louver, the upstream end portion is positioned on an imaginary plane that is obtained by extending the upstream guide surface of the up-and-down airflow direction louver toward the downstream side of the flow of the blowing air.

3. The indoor unit for an air-conditioning apparatus of claim 1, wherein the upstream end portion is positioned at a predetermined distance from the upstream guide surface toward the downstream end of the air outlet passage.

4. The indoor unit for an air-conditioning apparatus of claim 1, wherein the downstream guide surface and the upstream guide surface are connected to each other by a curved surface.

5. The indoor unit for an air-conditioning apparatus of claim 1, wherein a tangent line to the upstream end portion of the up-and-down airflow direction auxiliary louver in a direction along the air outlet passage is parallel to the downstream guide surface.

6. The indoor unit for an air-conditioning apparatus of claim 1, wherein the up-and-down airflow direction auxiliary louver is arranged at a predetermined distance from the downstream guide surface.

7. The indoor unit for an air-conditioning apparatus of claim 1, wherein a downstream end portion of the up-and-down airflow direction auxiliary louver, which is positioned on the downstream end of the air outlet passage, is directed toward the front surface of the casing.

8. The indoor unit for an air-conditioning apparatus of claim 1, wherein, in each of the up-and-down airflow direction louver and the up-and-down airflow direction auxiliary louver, the first rotation shaft and the second rotation shaft, which serve as respective centers of rotation, are arranged inside of the air outlet, wherein the up-and-down airflow direction auxiliary louver includes a plate-like portion, which is configured to guide the blowing air and forms the air outlet passage, and wherein the plate-like portion is positioned to protrude downward from the air outlet.

9. The indoor unit for an air-conditioning apparatus of claim 1, wherein the up-and-down airflow direction auxiliary louver is accommodated inside of the air outlet during stop of an operation.

10. The indoor unit for an air-conditioning apparatus of claim 1, wherein the up-and-down airflow direction louver covers the air outlet when operation of the indoor unit is stopped.

11. The indoor unit for an air-conditioning apparatus of claim 1, wherein the air outlet is opened at a lower surface of the casing, and wherein the up-and-down airflow direction auxiliary louver protrudes from the air outlet.

12. The indoor unit for an air-conditioning apparatus of claim 1, wherein when the operation of the indoor unit is stopped, the up-and-down airflow direction louver is rotated in a first direction and the auxiliary up-and-down airflow direction louver is rotated in a second direction, and the first and second directions are opposite to one another.

* * * * *